United States Patent [19]

Mermelstein

[11] 3,939,627

[45] Feb. 24, 1976

[54] APPARATUS FOR CAPPING CONTAINERS

[75] Inventor: Seymour Mermelstein, Newton, Mass.

[73] Assignee: Tyco Laboratories, Inc., Waltham, Mass.

[22] Filed: June 10, 1974

[21] Appl. No.: 477,700

[52] U.S. Cl. ..... 53/329; 53/298

[51] Int. Cl.[2] ..... B67B 3/04; B65B 53/02

[58] Field of Search ..... 53/329, 341, 342, 373, 53/379, 357, 184 S, 30 S, 42, 296, 298; 269/131, 132, 130

[56] References Cited

UNITED STATES PATENTS

| | | | |
|---|---|---|---|
| 558,760 | 4/1896 | Becker | 53/329 |
| 2,144,592 | 1/1939 | Gehman | 53/329 X |
| 2,572,704 | 10/1951 | Edgerton | 53/357 X |
| 3,262,245 | 7/1966 | Snow, Jr. | 53/184 S |
| 3,716,963 | 2/1973 | Amberg | 53/329 X |
| 3,783,582 | 1/1974 | Willvonseder | 53/329 X |

*Primary Examiner*—Travis S. McGehee
*Assistant Examiner*—Horace M. Culver
*Attorney, Agent, or Firm*—Schiller & Pandiscio

[57] ABSTRACT

The invention provides a machine for capping containers with closures made of heat shrinkable film and includes a film feeding mechanism, a film cutting mechanism, and a film shrinking head which is adapted to accommodate containers of different sizes. The film shrinking head comprises two elongate and opposed flexible heated members which are bowed away from one another so as to provide a space for introduction of a container and a sheet of heat shrinkable film that overlies the container, and means for drawing the two heated members and thereby the margins of the sheet of film tight against the rim of the container so as to cause the film to shrink and form a tight closure on the container.

19 Claims, 14 Drawing Figures

APPARATUS FOR CAPPING CONTAINERS

This invention relates to apparatus for capping and sealing containers using heat shrinkable plastic materials.

Previously efforts have been made to provide machines which may be conveniently used in drive-in eating establishments and commissaries to cap containers for hot and cold food using heat shrinkable plastic materials. Such machines are based on the principle that if a sheet of heat shrinkable plastic material of appropriate size is placed over the mouth of a container and bent so as to form a skirt around the periphery of the container, on application of heat the material will shrink around the rim of the container to form a tight closure or cover. The closure will tightly conform to the shape of the container, be it round, oval, rectangular or any other shape.

Although various machines have been designed for such purposes, they have suffered from a number of limitations including high cost, undue complexity, inability to handle different size containers, and unreliability.

Accordingly, the primary object of the present invention is to provide a new and improved apparatus for quickly capping and sealing containers using heat shrinkable plastic materials.

Another object of the invention is to provide a new method and apparatus for applying heat around the periphery of a container during formation of a closure by heat shrinkage of a heat shrinkable material.

A further object is to provide a new apparatus for capping containers with closures made from heat shrinkable film which is simple to manufacture, can be made at a reasonable cost, is reliable, can accommodate different size containers, and minimizes the factor of human error in operation as well as possible injury to the operator.

Another object is to provide a machine for applying a closure to a container and for forming an opening in the closure for insertion of a drinking straw.

Still another object is to provide an apparatus for capping containers with heat shrinkable film wherein the film is dispensed from a supply roll and cut into sheets which are used to make individual closures.

A more particular object of the invention is to provide a new and improved means for cutting a web of heat shrinkable plastic film into sheets for use in forming closures for containers.

The foregoing objects, and other objects hereinafter described or rendered obvious, are achieved by providing a capping machine which in its preferred embodiment includes a film shrinking head which comprises an elongate, flexible heating belt that is folded on itself so as to form two opposed portions, means for gripping said two opposed belt portions at one end thereof, means for gripping said two opposed portions at the other end thereof, means for moving the opposite ends of said belt portions toward and away from one another whereby to cause said belt portions to assume a curved configuration when said opposite ends are brought together, and means for supplying electric power to said belt whereby to provide heat for producing heat shrinkage of a plastic film. The machine further includes an access opening whereby a container to be capped may be inserted between the opposed belt portions, means for feeding a web of heat shrinkable plastic film from a supply roll, and means for severing said web into individual sheets which are disposed in a position to be intercepted by the container as the latter is inserted between the two opposed portions of the belt.

Other features and advantages of the present invention are described in or rendered obvious by the following detailed specification which is to be considered together with the accompanying drawings, wherein.

FIGS. 11A–D illustrate operation of the knife mechanism.

Machines constructed in accordance with this invention may utilize a variety of heat shrinkable thermoplastic films to provide closures for containers. The films may be clear, tinted or opaque, as desired. By way of example, the films may be made of polyolefins such as polyethylene, polypropylene and the like, vinyl chloride and vinylidene chloride polymers, polyamides such as nylon and the like, rubber hydrochloride, heat shrinkable polyesters such as polyethylene terephthalate, and polystyrene. The film materials may be homopolymers, copolymers, terpolymers and block polymers and the films also may be laminates. The selection of film shrinkability, shrinkage temperature, strength and opacity will be dictated primarily by the nature of the container material, the contents of the containers and attendant handling, shipping and storing requirements. For a more extended disclosure of the type of film that may be used and its heating requirements reference is made to U.S. Pat. Nos. 3,491,510, 3,274,302, 3,354,604, 3,427,789, 3,214,882, 2,904,943 and the patents and publications mentioned therein.

Figure 1:
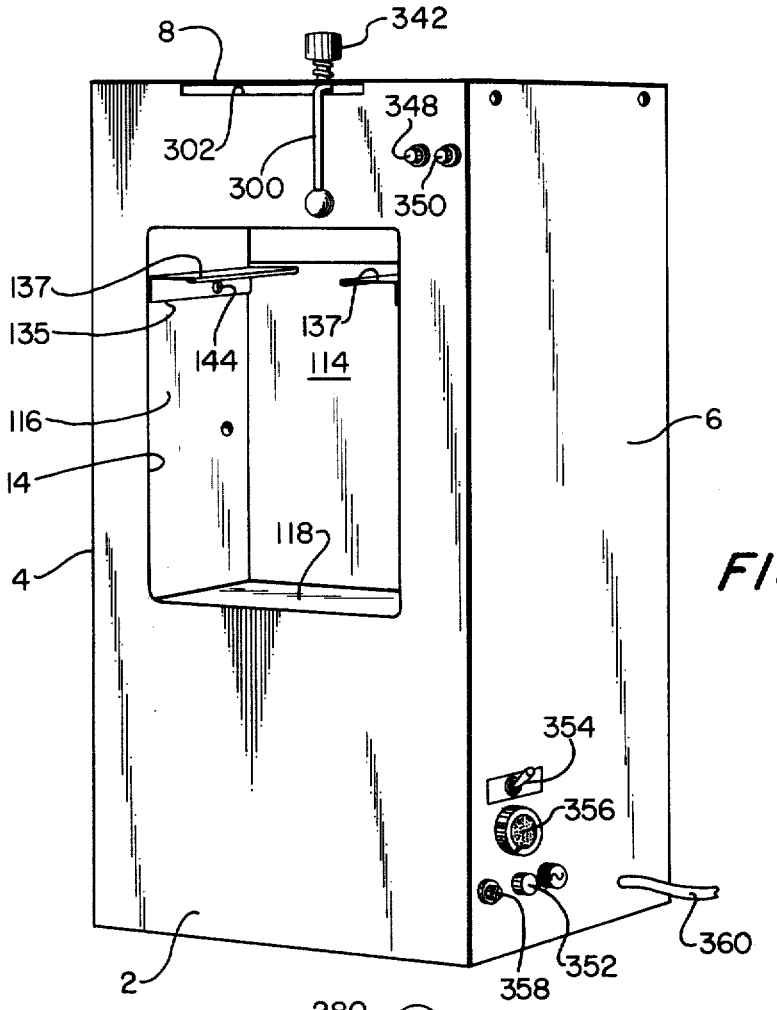
FIG. 1 is a perspective view showing the front and one side of a container capping machine constructed in accordance with the present invention.

Referring now to FIG. 1, the illustrated machine comprises a housing having a front wall 2, opposite side walls 4 and 6, and removable top and rear panels 8 and 10. The front panel is provided with a relatively large rectangular opening 14 which serves as an access hole whereby a cup or other container to be capped may be brought up into engagement with a sheet of heat shrinkable plastic film and the film shrinking head 210 hereinafter described.

Referring now to FIGS. 2 and 6–8, a supply roll 16 of heat shrinkable film 17 is supported within the housing on a pair of support bars 18 which are rotatably anchored to the side walls 4 and 6 of the housing. A pair of guides 20 are mounted on the forward rod 18 for the purpose of maintaining the supply roll 16 alinged with the film feeding mechanism hereinafter described.

The film 17 passes upwardly along the rear side of the housing under the influence of the feeding mechanism. The film passes behind a guide rod 22 and around rollers 24 which are rotatably mounted on a shaft 26. Shaft 26 and rod 22 are attached at their ends to a pair of bars 28 and 30 of channel shaped cross-section. Rod 22 is preferably rotatable on its longitudinal axis. A U-shaped support plate 32 is supported by the housing, the support plate comprising a front vertically-extending section 34 and opposite side sections 36 and 38 which extend along and are secured to side walls 4 and 6.

Each of the side sections 36 and 38 carries a pair of studs 40 for supporting bars 28 and 30, the outer sides of the latter having elongate slots 42 to accommodate the studs. The ends of studs 40 have a reduced diameter and are threaded to receive nuts 44 for securing bars 28 and 30. As is obvious, the elongate slots 42 permit a limited adjustment vertically of bars 28 and 30.

The feeding mechanism for transporting the film from the supply roll 16 comprises a rotatable shaft 46 which is journalled at its opposite ends in two identical bearing blocks 48 (only one of which is shown) which are affixed to mounting plates 50 (only one of which is shown) that are located close to but spaced from side walls 4 and 6.

Figure 6:
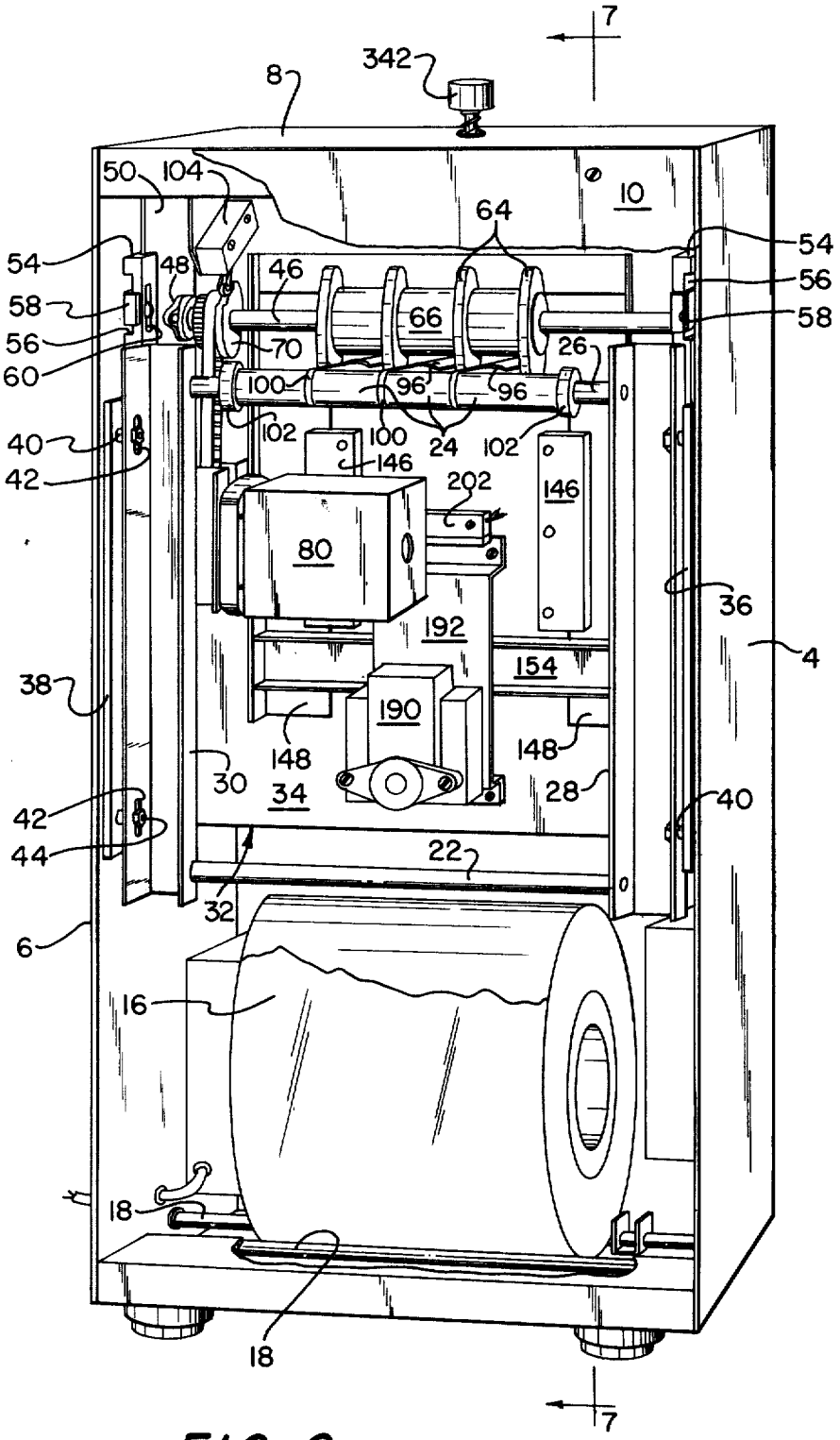
FIG. 6 is a perspective rear view of the same machine with a portion of the rear cover panel removed.
Figure 7:
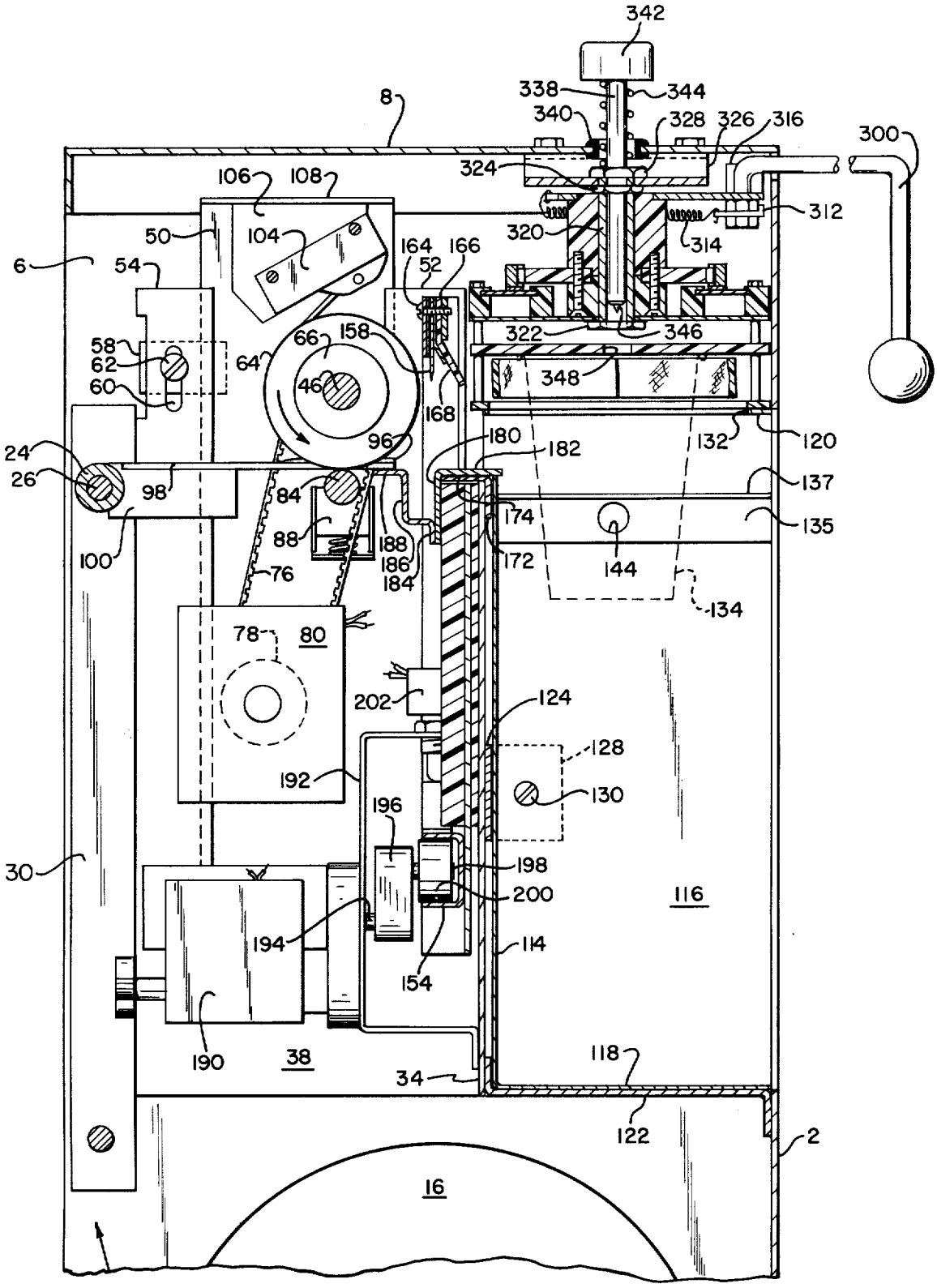
FIG. 7 is a sectional view taken substantially along line 7—7 of FIG. 6.
Figure 8:
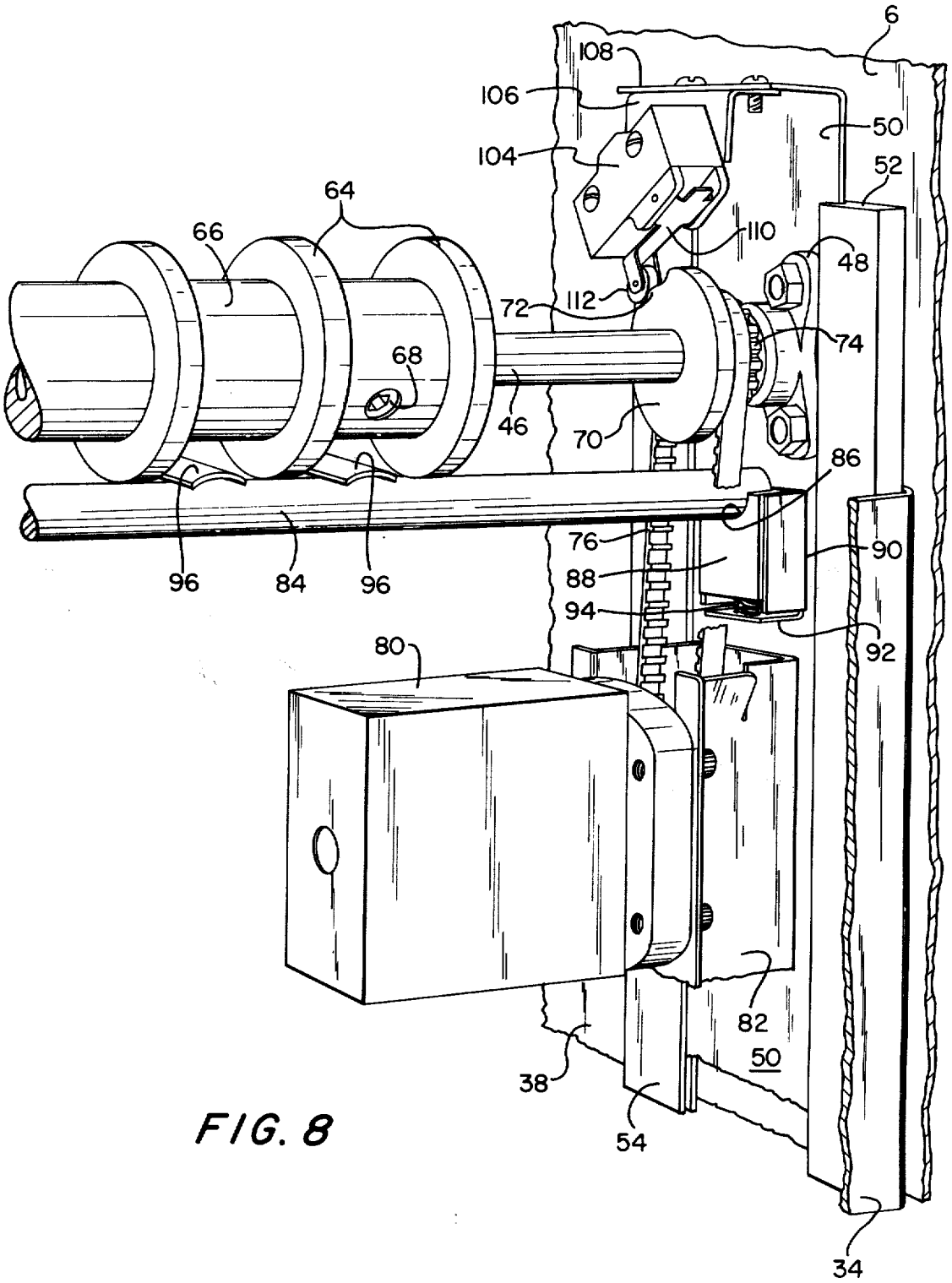
FIG 8 is an enlarged perspective view of a portion of the film feeding mechanism.
Figure 9:
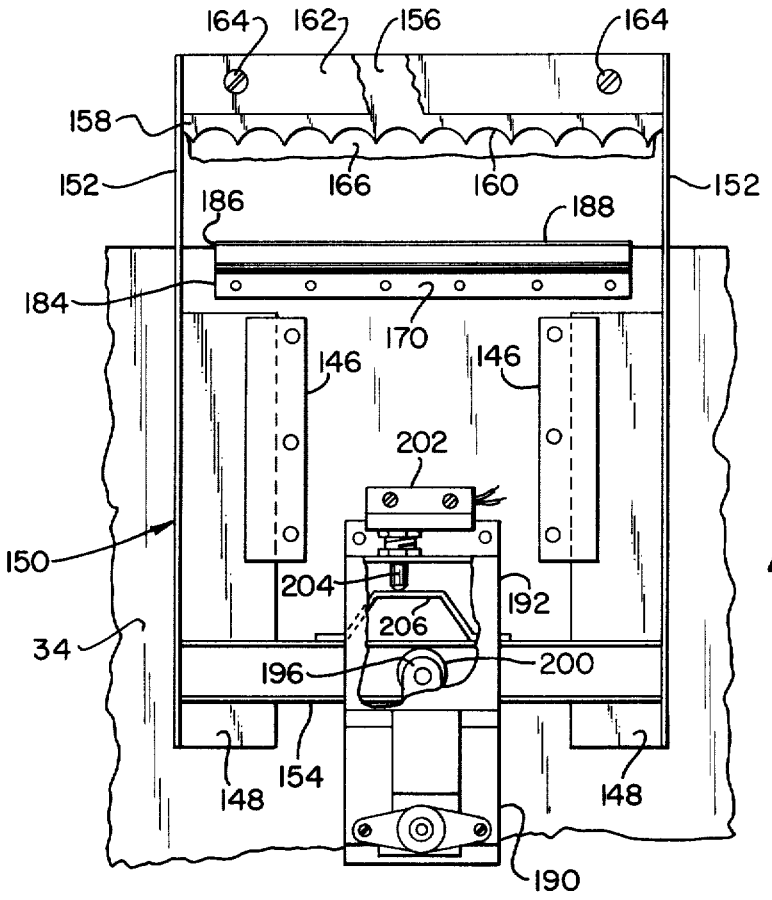
FIG. 9 is an enlarged fragmentary view in rear elevation of the knife mechanism.

Each of the mounting plates 50 is secured by a pair of vertical guide members 52 and 54, the latter having grooves to slidably accommodate the front and rear vertical edges respectively of the associated plate 50 as shown in FIGS. 6–8. The vertical guide members 52 and 54 that are adjacent to side wall 6 are secured to side sections 38 of support plate 32, and the other pair of like guide members (of which only a part of guide 54 is shown in FIG. 6) that are adjacent to side wall 4 are secured to side section 36 of support plate 32. The upper end of each rear guide member 54 is notched as shown at 56 to accommodate aa rearwardly extending arm 58 attached to the associated mounting plate 50, and is also provided with a vertically elongate hole 60 to accommodate a screw 62 that is screwed into a tapped hole in arm 58. Holes 60 allow the plates 50 to be adjusted vertically and screws 62 coact with rear guides 54 and arms 58 to releasably secure plates 50 against movement vertically. Mounted on shaft 46 are a plurality of feed rolls 64 with hubs 66. Set screws 68 (see FIG. 8) in hubs 66 lock feed rolls 64 to shaft 46. Rolls 64 are preferably made of a material that has a high friction coefficient and/or its periphery may be knurled to improve the gripping action on film 17. A cam 70 is mounted on shaft 46 at the end nearest to side wall 6. Cam 70 has a generally circular periphery except for a short section which is recessed and curved as shown at 72. Mounted on and affixed to shaft 46 between cam 70 and the adjacent bearing block 48 is a sprocket 74. The latter is engaged by a toothed belt 76 which runs over and engages a second like sprocket 78 (FIG. 7) which is attached to a channel shaped bracket 82 affixed to the adjacent mounting plate 50. Operation of motor 80 will cause shaft 46 (and thus rolls 64) to rotate in a counterclockwise direction as viewed in FIG. 7.

Located below the shaft 46 in contact with rolls 64 is a shaft 84. The opposite ends of the shaft 84 reside in semi-circular slots 86 formed in the upper side of bearing blocks 88 (only one of which is shown) which are disposed within and guided by channel members 90 that are affixed to mounting plates 50. Each of these channel members is provided with a bottom end tab 92 for the purpose of restraining one end of a compression spring 94 which engages the under surface of the associated block 88 and urges the block to force shaft 84 up into engagement with the rolls 64. Blocks 88 are made of a material having a low friction coefficient, e.g. Teflon, whereby to facilitate rotation of shaft 84 on its axis. Thus, as will be obvious to persons skilled in the art, shaft 84 functions as an idler roll which can rotate under the influence of rollers 64.

Referring now to FIGS. 6, 7 and 8, the hubs 66 of rolls 64 have a smaller diameter than the rolls per se in order to provide space to accommodate several fingers 96 which are disposed just above shaft 84. Commending at their front ends and continuing rearwardly for about half of their length, fingers 96 have a curved configuration in cross-section, as shown in FIGS. 6–8. The remainder of each finger 96 is flat as shown at 98 in FIG. 7. Formed integral with each finger at its rear end is an arm 100 which is flat and extends at a right angle to the flat portion 98. The rear end of each arm 100 has a hole to accommodate shaft 26 and is sandwiched between a pair of the rollers 24 as shown in FIG. 6. The rollers 24 are restrained against movement by two collars 102 which are mounted on and secured to rod 26. As is apparent for the foregoing description, the plastic heat shrinkable film 17 overlies arms 100 and fingers 96 and extends between the rolls 64 and shaft 84. Thus, the film is frictionally gripped by rolls 64 and shaft 84, with the result that when motor 80 is operating, the film will be pulled from supply roll 16 and transported along the path previously indicated by the rolls 64 acting together with the shaft 84. The function of the curved forward sections of fingers 96 is to cause the film to be gathered up in the spaces between rolls 64 so as to corrugate the film and thereby give it enough stiffness to move straight through the knife mechanism hereinafter described to a selected position below the film shrinking head.

Motor 80 is a brake gear motor, e.g. of the type having a magnetic brake or a cone-type friction brake. Such motors are well known and are available, for example, from Dayton Electric Mfg. Co. of Chicago, Ill. Accordingly, although not shown, it is to be understood that motor 80 includes a brake which is automatically engaged when the motor is deenergized and automatically disengaged when the motor is energized. Preferably but not necessarily, motor 80 is of the shaded pole type. Operation of the motor is controlled by a switch 104 which is mounted to a bracket 106 that is affixed to a flange 108 on the upper end of the mounting plate 50 that is nearest to side wall 6. Switch 104 is normally off and comprises a spring biased actuating arm 110 provided with a roller 112 that rides on cam 70. Switch 104 is open when roller 112 engages the recessed portion of cam 70 and is held closed by cam 70 so long as roller 112 is riding on the remainder of the peripheral surface of the cam.

Figure 2:
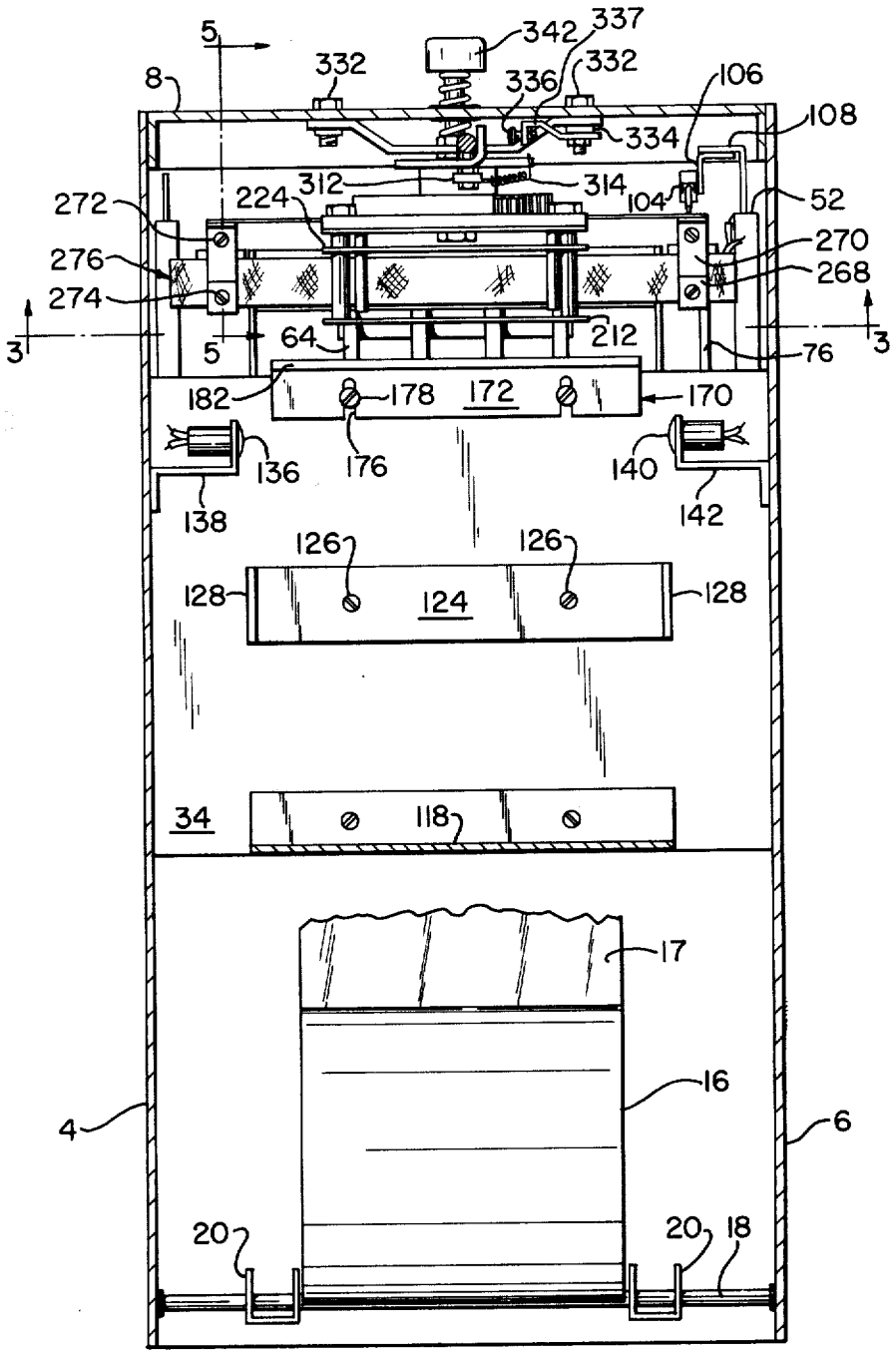
FIG. 2 is a sectional view in front elevation of the same machine, with the front panel and certain other parts removed.

Turning now to FIGS. 1, 2 and 7, means are provided for defining a compartment into which a container to be capped is introduced by the user via access opening 14. Such means comprise a receptacle that consists of a rear wall 114, two opposite side walls 116 (only one of which is shown), a bottom wall 118, and a top wall 120. Bottom wall 118 rests on and is reinforced by a horizontal plate 122 that is secured to the front wall 2 of the housing and also to the front section 34 of support plate 32. The rear wall 114 of the receptacle engages a strap 124 that is secured by screws 126 to the front section 34 of support plate 32. The ends of strap 124 are bent to form arms 128 that embrace the side walls 116 of the container receptacle and have tapped holes to receive screws 130 which extend through side walls 116 and function to receive the receptacle in place. The upper wall 120 of the container receptacle is provided with a relatively large opening 132 through which a container 134 may be brought up against the film shrinking head. In order to cap a container, it is necessary that a piece of film 17 be positioned to intercept the container 134 as it is raised up into the film shrinking head. Accordingly, a pair of bars 135 are affixed to the inner surfaces of the side walls 116 of the receptacle, the bars being L-shaped in cross-section so as to provide ledges 137 which function as supports for the piece of film.

Actuation of motor 80 of the film feeding mechanism may be caused automatically or by manual operation of a control switch. For automatic operation, an electric eye is employed which comprises a light source 136 mounted on a bracket 138 affixed to side wall 4 and a light detector 140 mounted on a bracket 142 affixed to side wall 6. Light source 136 and detector 140 are located between the side wall 116 of the container receptacle and openings 144 are provided in side walls 116 and bars 135 whereby light may travel from light source 136 to detector 140. The light source and detector are located so that the light beam will be interrupted by a container when the container is inserted in the receptacle.

Turning now to FIGS. 2, 6, 7 and 9, a knife mechanism is provided for severing film 17 forwardly of feed rolls 64 so as to provide a piece of film which can be used to form a closure for a container 134. The knife mechanism comprises a pair of spaced vertical guide plates 146 which are affixed to the rear side of the front section 34 of support plate 32. Guide plates 146 are undercut along one edge so as to provide channels or grooves for slidably receiving a pair of flat rails 148 which form part of a knife blade carriage 150. The latter also comprises a pair of side members 152 which are integral with rails 148, and a cross-arm in the form of a channel member 154 which is attached to rails 148 and members 152 adjacent their bottom ends. Connected to and extending between the upper ends of side members 152 is another cross arm 156. Secured to cross arm 156 is a knife blade 158 having a scalloped knife edge 160. Knife blade 158 is clamped to cross-arm 156 by a retainer plate 162 and screws 164. Also clamped between cross arm 156 and retainer plate 162 is a flexible blade 166 which is preferably made of an elastomer and is formed so that a lower portion thereof is inclined so as to extend downwardly and forwardly away from knife blade 158 as shown at 168 in FIG. 7.

Still referring to FIGS. 2, 6, and 7, an angle iron 170 with a vertical section 172 and a horizontal section 174 extends along and over the upper edge of the forward section 34 of support plate 32 and its vertical section is provided with two slots 176 to accommodate the shanks of screws 178 which are received in tapped holes in support plate 32. Slots 176 allow the height of the angle iron to be adjusted and screws 178 serve to lock it to support plate 32. Associated with angle iron 170 is a second angle iron comprising a vertical section 180 and a horizontal section 182. Horizontal section 182 overlies and is welded to the horizontal section 174 of angle iron 170, while its vertical section 180 extends down behind and spaced from the forward section 34 of support plate 32. Attached to the vertical angle iron section 180 is an elongate bar 184 which has an offset portion 186 so as to define a channel between it and angle iron section 180 to accommodate knife blade 158 when the knife blade is moved down during a film cutting operation. Bar 184 is formed with a rearwardly extending flange 188 at its upper edge which functions to support the forward ends of fingers 96 as shown in FIG. 7.

Movement of knife blade carriage 150 is achieved by operation of a motor 190 which is attached to a U-shaped bracket 192 attached to the rear side of the front section 34 of support plate 32. Motor 190 has an output shaft 194 to which one end of a crank arm 196 is affixed. Attached to the other end of crank arm 196 is a stub shaft 198 carrying a roller 200 which ends into the open space of channel member 154. Motor 190 preferably is a brake gear motor like motor 80. When motor 190 is energized, crank arm 196 will rotate and consequently the roller 200 will cause the knife blade carriage to move up and down. Operation of motor 190 is controlled by a switch 202 that is afixed to the rear side of the front section 34 of support plate 32. Switch 202 is a normally closed push-button switch and its push-button 204 extends through an oversized hole in bracket 192 in position to be engaged and depressed by a generally U-shaped member 206 affixed to the upper side of channel member 154 when the carriage 150 reaches the upper end of its stroke. Switch 202 opens when its push-button is depressed.

Figure 5:
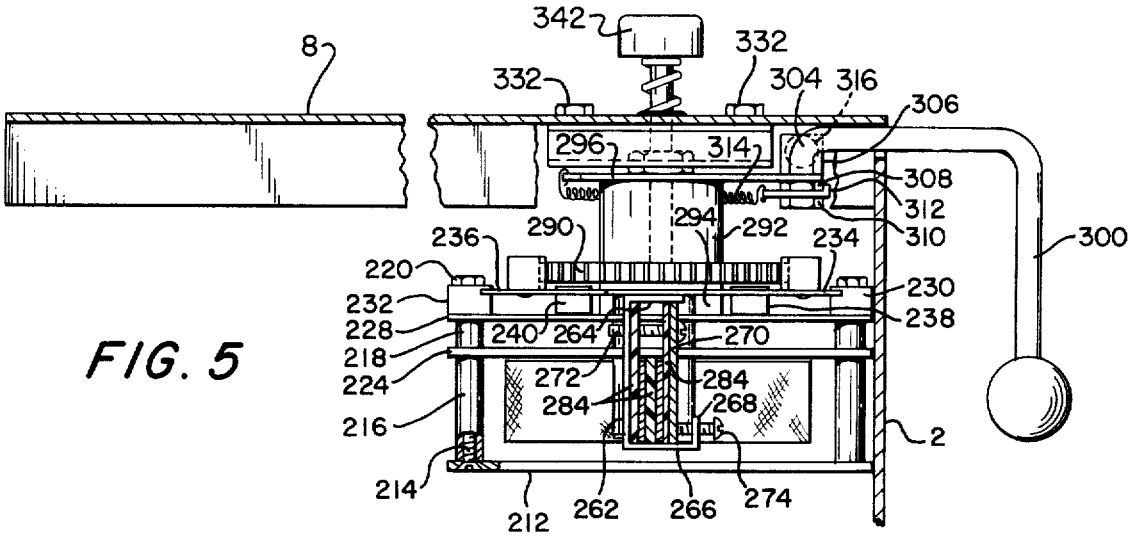
FIG. 5 is an enlarged side elevation, partly in section, of the film shrinking head taken along line 5—5 of FIG. 2.

Turning now to FIGS. 3, 4, 5 and 7, the film shrinking head is identified generally by the numeral 210. This head is mounted to the cover panel 8 and comprises three plates 212, 224 and 228 which are secured in spaced relation to each other by four standoffs, each standoff comprising a screw 214, a relatively long hollow cylindrical spacer 216, a relatively short hollow cylindrical spacer 218, and a nut 220. Plate 212 is made of metal and is provided with a large circular opening 222 which is approximately the same size as the opening 132 in the upper wall of the container receptacle. Plate 224 is made of a material which is a relatively poor heat conductor. Preferably, plate 224 is made of a high temperature plastic material, such as a phenolic composition, and is provided with a plurality of holes as shown at 226 (FIG. 3) for permitting passage of hot air. Plate 228 is preferably made of metal and affixed to its upper side along opposite side edges are two guides 230 and 232. These guides are provided with holes through which the screws 214 extend and are engaged by the nuts 220 as shown in FIG. 5. Guides 230 and 232 are provided with grooves on their inner edges to accommodate two slides 234 and 236. Additionally, two other guides 238 and 240 are attached to the upper side of plate 228 in parallel spaced relation to the guides 230 and 232. Guides 238 and 240 are provided with grooves similar to those in guides 230 and 232 for receiving a longitudinal edge of the associated slide 234 or 236. Slides 234 and 236 are supported by guides 230, 232, 238 and 240 in spaced relation to plate 228, as seen in FIG. 5.

The slides 234 and 236 are essentially U-shaped, each comprising an elongate main section 242 and parallel end arms 244 and 246. As seen in FIG. 5, the slides are mounted so that their end arms extend toward one another. Mounted on the main portions 242 of slides 234 and 236 are elongate gear racks 248 and 250 respectively. These gear racks extend lengthwise of the slides, with their teeth facing but vertically spaced from the guides 238 and 240.

Figure 3:
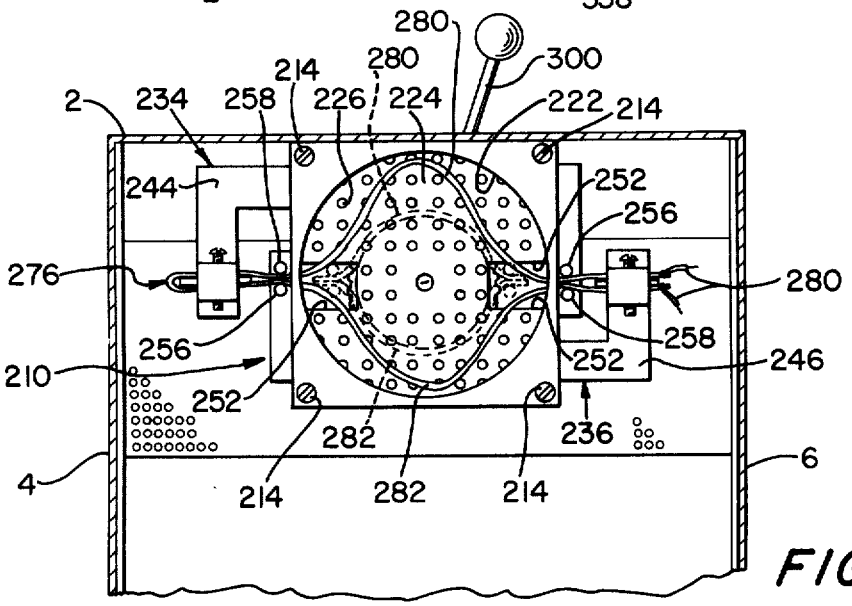
FIG. 3 is an enlarged fragmentary sectional view taken substantially along line 3—3 of FIG. 2 and illustrating certain features of the film shrinking head.
Figure 4:
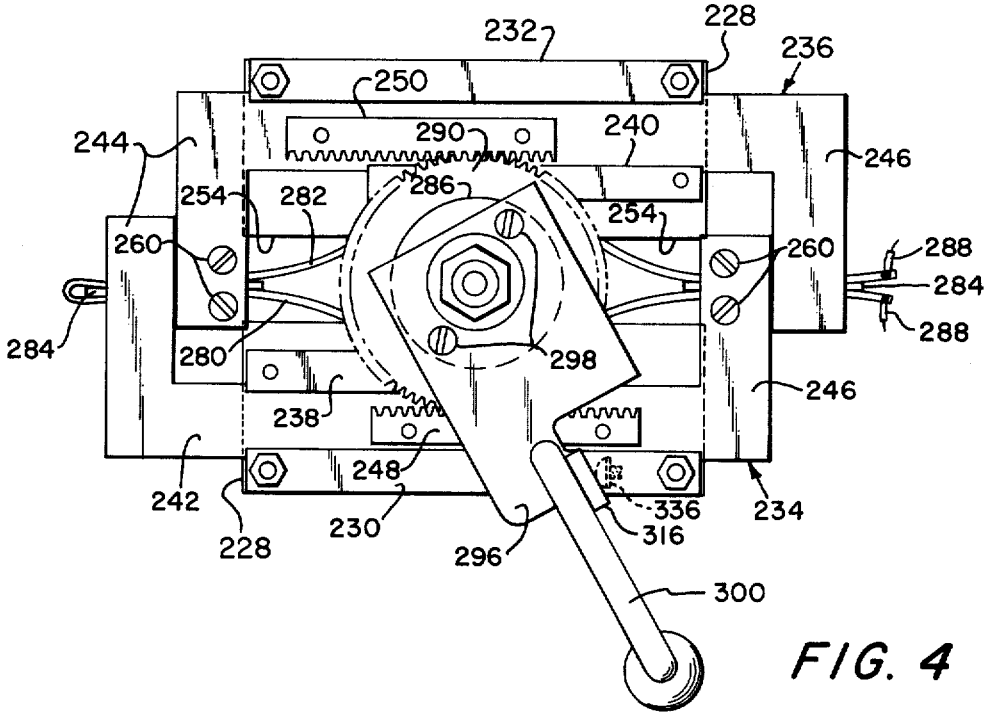
FIG. 4 is an enlarged plan view of the film shrinking head dissociated from the machine.

The plates 224 and 228 are notched at two of their opposite edges, as shwon at 252 and 254 respectively in FIGS. 3 and 4. The notches in plate 228 are aligned with the corresponding notches in plate 224. The purpose of these notches is to avoid interference between plates 224 and 228 on the one hand and the two pairs of guide pins 256 and 258 carried by the two slides on the other hand. The guide pins 256 and 258 are attached to the undersides of the slides by screws 260 as shown in FIG. 4. The guide pins 256 and 258 are attached to the ends of the arms 246 and 244 respectively of slides 234 and 236 respectively.

Affixed to the arms 224 and 246 of slides 234 and 236 respectively are like bracket member 262. Bracket members 262 are flat plates bent to form a flange 264 which is attached to the arm of the associated slide, and a second flange 266 which is formed with a upturned lip 268. Positioned between the flanges 264 and 266 of each bracket member is a pressure plate 270. Pressure plate 270 has a hole to receive a screw 272 which is screwed into a tapped hole in bracket member 262. Additionally, the lip 268 of each bracket member 262 is provided with a threaded hole for receiving a second screw 274 which engages the pressure plate 270. The purpose of the bracket plates 262 and pressure plates 270 is to secure a heating belt asembly.

As seen in FIGS. 2–5 and 7, the heating belt is essentially a one-piece belt 276 which is folded on itself as shown at 278 so as to form two discrete belt portions 280 and 282. The folded portion of the belt extends between the bracket 262 and pressure plate 270 carried by slide 234, while the opposite ends of the belts are brought together and positioned between the bracket 262 and the pressure plate 270 carried by slide 236. Three flat electrically insulated members 284 are associated with each bracket member 262, with one member 284 being disposed between the two folded belt portions and the other two being disposed between the belt and bracket 262 and pressure plate 270. Screws 272 and 274 extend through holes in insulators 284 and are adjusted so that the belt and insulators are clamped tight between bracket 262 and pressure plate 270.

The belt 276 is essentially a flexible high temperature electrically insulated heat resistant heating tape which embodies an insulated electrical resistance heating element. By way of example, the belt 276 may consist of finely stranded electrical resistance wires insulated with braided glass fibers and knitted into a flat tape with glass yarns, and as an optional measure, such a flat tape may be insulated with a braided glass yarn covering or a silicone rubber sheathing. Heating tapes of the foregoing type are well known and are made, for example, by Briscoe Manufacturing Company, P.O. Box 628, Columbus, Ohio. Still other forms of electrical heating tapes may be used as the belt 276. Thus, for example, they may consist of polytetrafluoroethylene coated resistance wire encased in a thin, flat woven cover of fiberglass. Regardless of what form of electrical heating belt is used, its electrical resistance heating element(s) is provided with terminal lead wires 288 for coupling it by suitable means (not shown) to a source of electric power. The two portions 280 and 282 of the belt 274 are disposed between the guide pins 256 and 258 as shown in FIG. 3 with the result that if the slides 234 and 236 are moved lengthwise of guides 230, 232, 238 and 240, the guide pins 256 and 258 will move along the belt portions 280 and 282.

The two slides 234 and 236 are movable lengthwise of the associated guides by coaction of the racks 248 and 250 with a drive gear 290 that is formed with an enlarged hub 292. Gear 290 is disposed above and is spaced from plate 228 by an annular spacer 294. Attached to the upper end of hub 292 is a lever arm 296. Screws 298 secure the lever arm to hub 292.

Rotation of gear 290 by lever 296 is achieved via a handle 300 which extends through a slot 302 in the front panel 2. Handle 300 is provided with a bent end portion 304 that extends through a hole in lever 296 which is large enough to allow the handle to pivot relative to the lever. Handle 300 has a flange 306 which engages the lever and is retained in the lever by an annular spacer 308 and a nut 310 that is screwed onto a screw thread formed on its end portion 304. Pivotally mounted on end portion 304 between spacer 308 and nut 310 is a small lever 312, and attached to one end of lever 312 is a tension spring 314. The opposite end of spring 314 is attached to lever 296 so as to urge handle 300 to pivot counterclockwise relative to lever 296 (as viewed in FIG. 4). Additionally, lever 296 is provided with an upturned stop extension 216 which projects up alongside the handle and limits the extent to which spring 314 can cause it to pivot relative to lever 296.

Gear hub 292 and gear spacer 294 are coupled to plate 228 by a hollow shaft 320 that extends through a center hole in plate 228 and is provided with an enlarged head 322. The upper end of shaft 320 is threaded to accommodate a first nut 324 which engages the end of hub 320 so as to rotatably lock the shaft to the hub. The upper end of shaft 320 extends through a hole in a bracket plate 236 and is secured to the latter by a second nut 328. As seen in FIGS. 2, 5 and 7, bracket plate 326 is generally U-shaped and has flat ears 330 which are secured to cover panel 8 by screws 332 and nuts 334. Also secured to the cover panel 8 by means of screws 332 and nuts 324 is a fixed stop, members 336 and 337, which is arranged to engage the extension 316 of lever 296.

Mounted within the hollow shaft 320 is a cylindrical plunger 338. The plunger extends through an aperture in the cover panel 8, the aperture being provided with an annular grommet 340 which acts as a bumper for the enlarged head 342 on the upper end of the plunger. Surrounding the plunger 328 is a compression spring 344, one end of which engages the head 342 of the plunger and the other end of which was seated within the nut 328 and engages the upper end of shaft 320. The bottom end of plunger 338 is formed with a sharp point 346. The length of the plunger 338 is such that the point 346 is retracted within the hollow shaft 320 when the spring 344 holds the plunger in the elevated position shown in FIG. 7. As the plunger is depressed far enough for its head to engage grommet 340, the point 346 will move down far enough to puncture a closure formed on a container 134 positioned as shown within the sealing head. In this connection it is to be noted that the plate 224 is provided with a center aperture 348 which is large enough to accommodate the plunger when the latter is depressed.

The sealing head is held against rotation on the axis of shaft 320 by virtue of engagement of the front edges of its plates 212, 224, and 228 with the front panel 2, as shown in FIG. 7. The spring 314 acts to urge lever 296 in a counterclockwise direction (as viewed in FIG. 4), and holds the vertical extension 316 of the lever against stop member 336. When lever 296 is in the limit position shown in FIG. 4, the slides are positioned as shown in FIG. 3 and the belt portions 280 and 282 are bowed away from one another in the manner illustrated in FIG. 3. This bowing out is due to the fact that the belt is resilient and its overall length between the two bracket members 262 is substantially greater than the distance between the two bracket members.

If the handle 300 is now moved to the left, i.e., clockwise as seen in FIG. 4, the lever 296 will move in the same direction. When this occurs, slides 234 and 236 will move so as to increase the distance between the two brackets 262, whereby the bowed portions of the heating belt will be urged to unbow and move closer to one another along their lengths. At the same time, the guide pins move along the belt portions 280 and 282 toward one another so as to decrease the length of the bowed sections and maintain the bow in each belt symmetrical with respect to the center of the cap aperture 222 in plate 212. Handle 300 will remain aligned with the projection 316 on lever 296 until the force required to rotate lever 296 clockwise exceeds the force of spring 314, in which case handle 300 will commence to pivot clockwise (as viewed in FIG. 4) with respect to lever 296. The relative pivotal action of handle 300 will occur when the belt portions 280 and 282 engage a container 134 during a capping operation and will also occur if the lever 296 has moved far enough for the arms 244 of slide 236 and arm 246 of slide 234 to engage the ends of guides 238 and 240. When the handle is released, the spring 314 will urge the lever 296 clockwise back to its original position against stop 336. It is to be understood that the length of the heating belt is such that the length of the portions 280 and 282 is greater than the distance between the two belt brackets 262 when the slides are moved together far enough to engage the ends of the guides 238 and 240. Accordingly, the belt portions 280 and 282 will still be bowed relative to one another in all allowable portions of slides 236 and 238.

Provision may be made for automatic or selective operation of the film feeding and film cutting mechanisms and also for means to appraise the user of the state of the heating element. Accordingly, referring now to FIGS. 1, 2 and 6–9, the illustrated machine comprises a pair of push-button switches 348 and 350 which are mounted to front panel 2 and are connected into the power circuits of film feed motor 80 and the knife mechanism motor 190. Additionally, an On-Off push-button power switch 352 and a two position mode control toggle switch 354 are mounted to side panel 6. A rheostat (i.e., a variable resistor) 356 and a light 358 are mounted to the side panel 6. A power cord 360 is provided to connect the electrical circuits of the machine to a source of a.c. electrical power. Switches 348 and 350 are of the type that are normally open and close, only when their push-buttons are depressed. Swtich 352 is of the type which changes states when its push-button is depressed and maintains its state until its push-button is again depressed. Light 358 is connected so as to be illuminated when switch 352 is closed.

Figure 10:
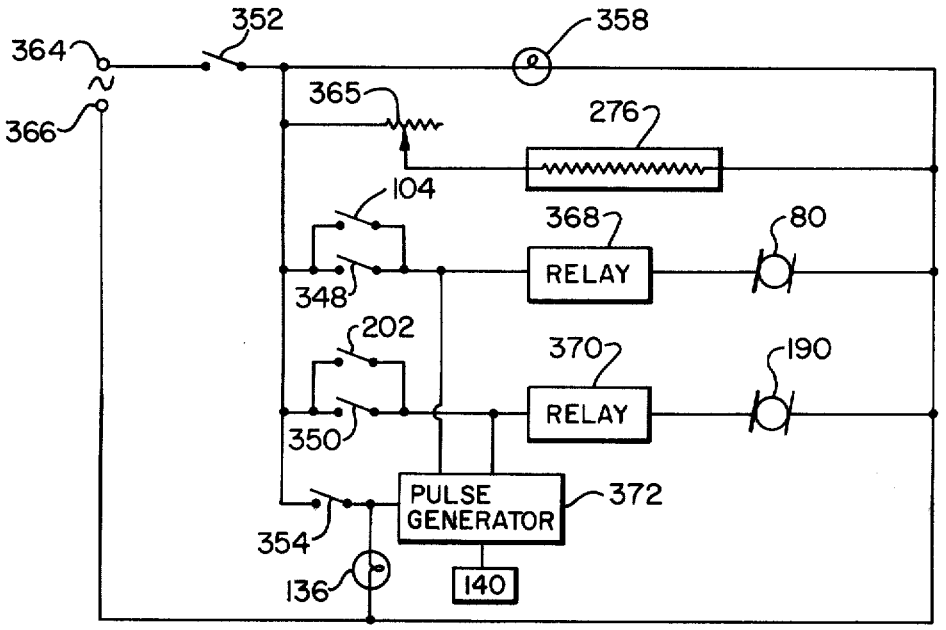
FIG. 10 illustrates the electrical system.

Referring now to FIG. 10, line cord 362 is connected to terminals 364 and 366. Terminal 364 is connected to terminal 366 via power switch 352 and light 358. Connected in parallel with light 358 is rheostat 356 and the electrical resistance element of heater belt 276. Also connected in parallel with light 358 is switch 348, a relay 368 and motor 80. Switch 104 is connected across switch 348. Also connected in parallel with light 358 is switch 350, a relay 370 and motor 190. Switch 202 is connected across switch 350. Connected in parallel across switches 348 and 350 is switch 354 and an electronic pulse generator 372 which is connected so as to respond to photodetector 140. The pulse generator has two output lines which are connected to relays 368 and 370 and is adapted to produce a current pulse to set relay 370 when the light beam from light source 130 is interrupted by a container to be capped and to produce another current pulse to set relay 368 when the container is moved out of the way of the light beam. The light source 136 is connected between terminals 364 and 366 via switches 352 and 354.

Operation of the machine will now be described with power switch 352 closed and switch 354 in the open or "manual" position. First the user closes switch 348. When this occurs, relay 368 is set to provide power to motor 80, whereupon the latter begins to operate. As soon as shaft 46 begins to rotate, switch 104 will close to keep relay 368 set even through switch 348 is released and allowed to reopen. Motor 80 will turn shaft 46 one revolution and will stop when cam 70 reopens switch 104. The single revolution of motor 80 is sufficient to feed the film 17 far enough for its forward end to overlie the front edges of ledges 137. After motor 80 has stopped, the operator closes switch 350. This sets relay 370 to provide power to motor 190. Operation of motor 190 causes crank arm 196 to reciprocate the knife assembly carriage between the elevated at-rest position shown in FIG. 7 and a second lower position wherein knife blade 158 projects into the channel formed by angle iron section 180 and offset portion 186 of bar 184 (see FIG. 11D). Almost as soon as the knife carriage starts moving downward, bumper member 206 moves away from switch 202, thus allowing the switch to close and keep relay 370 set even though switch 350 is released and allowed to reopen.

On the downward stroke of the knife carriage, the knife bladd 158 pierces and severs the portion of film 17 that extends between angle iron section 182 and flange 188 of bar 184. As the knife carriage moves up again and approaches its original elevated at-rest position, bumper member 206 will re-engage and thereby reopen switch 202, shutting off motor 190 and stopping the knife carriage. A container may now be capped with the piece of film that has been cut and which is now supported on ledges 137.

Figure 11A:
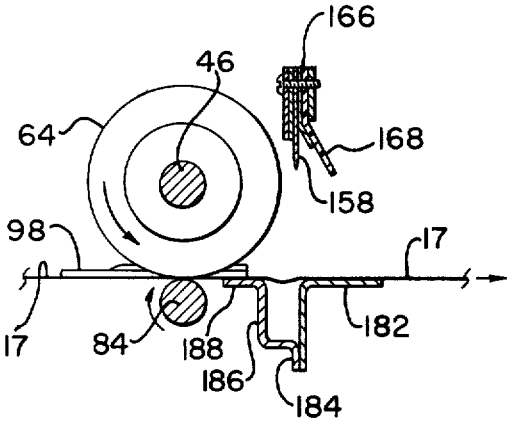
Figure 11B:
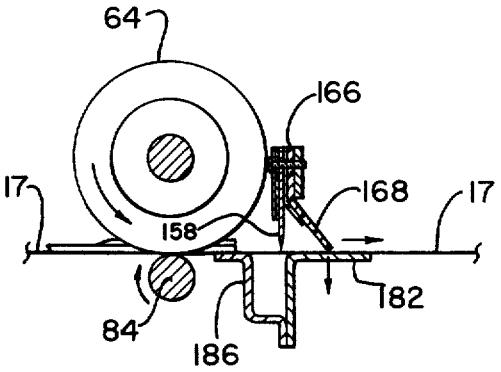
Figure 11C:
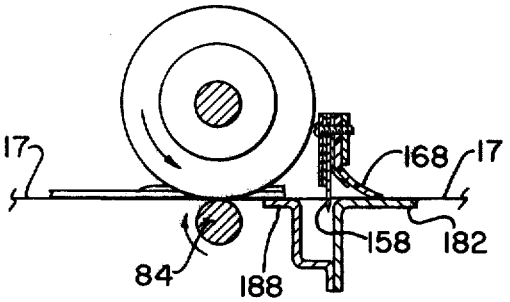
Figure 11D:
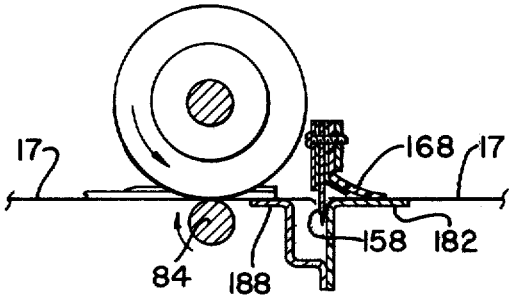

FIGS. 11A–D illustrate how severing of the film is accomplished by knife blade 158. The film severing operation requires that tension be maintained on the film as it is cut. The drive rolls 64 cooperate with shaft 84 to lock the supply end of film 17, while the flexible blade 166 acts to retain the forward end of the film as cutting is accomplished. As shown in FIG. 11B, as the knife carriage moves downward, flexible blade 166 engages the film just above angle iron section 182 and then, by virtue of its inclined angle and its downward movement, blade 166 subjects the film to both a vertical vector clamping force and a horizontal vector tensioning force. Stated another way, blade 166 simultaneously presses the film down against angle iron section 182 and urges the film forward away from rolls 64, thereby removing any slack in the film (e.g., due to bending under its own weight as shown in FIG. 11A) and also compensating for any film stretch capability and any tension relaxation that might be caused by any play in the feed roll mechanism. Maintaining adequate tension in the film is necessary to prevent incomplete cutting of the film by knife blade 158, especially if the knife blade has become dulled by excessive use. FIG. 11B shows the relative positions of knife blade 158 and the flexible squeegee blade 166 as the knife blade begins to act through the film. The cutting action is initiated by the several points on the scalloped edge of the knife which serve to pierce the film. The squeegee continues to flex as the knife moves down and maintains the film under tension even though some relaxation of the film may tend to occur as it is being pierced (FIG. 11C). The friction force exerted by the squeegee on the film is enough to prevent it from slipping even when the knife blade is so dull that an excessive pressure is required to cause the knife to pierce the film. FIG. 11D shows the knife blade at the end of its down stroke and also helps illustrate a further function of flexible blade 166. When the knife blade has fully severed the film and begins to move up again, the squeegee blade 166 keeps the cut piece of film clamped against shelf 182 until the knife has moved back above it, thereby preventing the knife blade from carrying the cut piece of film upward as may occur, for example, if the knife blade has become sticky due to accumulation of foreign matter or as a result of static electricity.

Automatic operation of the film cutting and feeding mechanisms is effected by placing switch 354 in the closed position, whereby to enable the pulse generator to respond to the output of photodetector 140. For operation in the automatic mode, it is essential that the film extend forward over and be supported by the ledges 137 which may be accomplished by closing switch 348 as previously described. If now a container to be capped is inserted into the machine via the access opening 14 and moved up against the portion of the film resting on ledges 137, the light beam from light source 136 will be interrupted, whereupon the output of the photodetector will cause pulse generator 372 to momentarily set relay 370 and thereby turn on knife mechanism motor 190. The pulse output from generator 372 is long enough to keep the relay 370 in the set position until switch 202 is closed as a result of downward movement of the knife carriage, whereupon the relay 370 is maintained in its set condition via switch 202. The knife mechanism motor 190 will complete one cycle of revolution as previously described and will turn off when switch 202 is reopened. Thereupon a user may effect capping of the container with the severed piece of film in the manner hereinafter described. When the capping operation is completed and the capped container is pulled down from the film shrinking head, the light beam will again impinge on detector 140. When this occurs, the output from the detector 140 will cause the pulse generator 372 to produce another pulse to set relay 368, thereby actuating motor 80. The current pulse from generator 372 is long enough to maintain relay 368 set until switch 104 is closed by operation of cam 70, whereupon the relay 368 is maintained in its set condition by switch 104 to allow motor 80 to complete a full cycle of revolution. Motor 80 will stop when switch 104 is reopened by cam 70. This cycle of operation of motors 190 and 80 will be repeated when another cup is inserted in the machine. Pulse generator 372 is rendered inoperative when switch 354 is moved to its open or manual position.

The capping operation is executed by movement of handle 300. Assuming that a sheet of film has been severed from the web by operation of the knife mechanism and is supported on the ledges 137, the operator engages the underside of the sheet of film with a container to be capped and raises the container up into the film shrinking head via the opening 222. The sheet of film resting on ledges 137 is engaged and carried upward by the open end of the container through the opening 222 and between the bowed portions 280 and 282 of the heating belt far enough for it to engage the perforated plate 224. The sheet of film is substantially square in shape and its side dimensions exceed the diameter of aperture 222, with the result that the marginal portions of the sheet of film will be forced by plate 224 to be draped down over the rim of the container as it is moved through the aperture 222. With the container and film so positioned, the operator then moves the handle 300 to the left (as seen in FIG. 1), far enough for the bowed portions of the heated belt to draw the film around the rim of the container, in the manner illustrated in dotted lines in FIG. 3. The belt is held in engagement with the container and film for a period of time, usually in the order of two seconds, sufficient for the applied heat to cause the marginal portions of the film to shrink tight around the rim of the cup. Additional shrinking of the portion of the film that extends across the end of the cup is accomplished by heat received from plate 224 and also from conduction from the heated belt, but this shrinkage is substantially less than the shrinkage which occurs at the rim of the cup since the temperature of the plate 224 is less than that of the heated belt. Thereafter the handle 300 is moved back to is original position to release the capped container and the latter is then withdrawn from the machine. If desired, the closure formed by the heat shrinking film may be punctured so as to permit introduction of a drinking straw. This is accomplished after the capping operation has been completed and before the container is withdrawn from the film shrinking head. The closure is punctured by depressing the plunger 340. The sharp end 346 on the plunger is preferably elongate in one direction ahd has a razor edge so that the puncture is actually a short slit, preferably about one-fourth inch in length. It has been found that this form of puncture will not leak liquid (or else, only very slowly) from the container if the container is accidentally tipped on its side or upside down. Nevertheless, the puncture facilitates introduction of a drinking straw into the container.

Obviously the above-described invention is susceptible of a number of modifications. Thus, for example, the heating belt 276 may actually comprise two discrete heating belts which are disposed in confronting relation and have their corresponding ends clamped in the bracket members 262, with the heating elements of the two belts being connected, either in series or in parallel as preferred, to the source of electric power. Thus in the appended claims, the requirement of two belts or two electrically heatable flexible members is intended to denote two sections of a single belt or to discrete belts. It is also appreciated that other means may be employed for controlling operation of the film feeding and film cutting mechanisms, e.g., the motors 80 and 190 and the switches 104 and 202 could be replaced by electric motors that are provided with single revolution clutches.

The principal advantage of the invention is that it is adapted to apply tight, substantially non-leaking closures made of heat shrinking film to containers of different sizes, since the bowed portions of the heated belt can be drawn together as required to engage different size containers. A further advantage of the invention is that the knife mechanism and the film shrinking head form separate subassemblies and, therefore, can be individually removed from the machine to facilitate inspection and repair. Another advantage is that the knife mechanism is simple yet is capable of rapidly and neatly severing the film. Still another advantage is that edge portions of the piece of film that has been heat shrunk to form a closure extend down along the side of the capped container and thus can function as a tab whereby the closure can be torn off of the container. Still other advantages will be obvious to persons skilled in the art.

What is claimed is:

1. Apparatus for capping the end of a container with a closure formed from a sheet of heat shrinkable plastic film comprising:

a film shrinking head which includes a pair of flexible electrically heatable members, first means for holding said members at one end thereof, second means for holding said members at the opposite end thereof, and bidirectionally movable means coupled to said first and second means for selectively moving said first and second means in a first direction whereby said members are caused to bow away from one another intermediate their ends so as to provide a space for insertion of a container or in a second direction whereby to draw said members closer together intermediate their ends;

sheet supporting means for supporting a sheet of heat shrinkable film below said members in a position to be engaged and raised by a container to be capped when the container is moved up between the two members;

means located between said members and said sheet supporting means for causing portions of said sheet to fold down over the rim of the container as the container is moved up between said two members; and means for operating said bidirectionally movable means so as to cause said members to be drawn together around the rim of the container whereby heat from said members will cause said sheet to shrink tight about the rim of the container.

2. Apparatus according to claim 1 wherein said bidirectionally movable means comprises first and second arms secured to said first and second means respectively, and movable means coupled to said arms for selectively causing said arms to move said first and second means in said first or second directions.

3. Apparatus according to claim 2 wherein said arms extend parallel to one another.

4. Apparatus according to claim 2 wherein said movable means comprises a rotatable gear, and further wherein said film shrinking head includes gear racks connected to said arms and engaged by said gear.

5. Apparatus according to claim 1 further including spring means for biasing said first and second means against movement in said second direction.

6. Apparatus according to claim 1 further including selectively operable means for puncturing said sheet after it has been shrunk tight onto said container, said selectively operable means comprising a puncture tool, means mounting said puncture tool for reciprocal movement into and out of the space between said belts, and means for holding said puncture tool out of said space.

7. Apparatus according to claim 6 comprising a support for said film shrinking head, said support and said puncture tool mounting means being connected to one another.

8. Apparatus according to claim 1 further including selectively operable means for feeding a continuous web of said film onto said sheet supporting means, and knife means for cutting said web so as to produce a sheet of said film.

9. Apparatus according to claim 8 wherein said knife means is located close to said sheet supporting means and comprises a knife blade located above the level of said sheet supporting means, and means for moving said knife blade down through and then up away from said web whereby to sever said sheet from said web.

10. Apparatus according to claim 9 further including means for holding said web taut as it is engaged by said knife blade.

11. Apparatus according to claim 10 wherein said web holding means comprises means connected to said knife means for engaging said web adjacent to said sheet supporting means as said web is engaged by said knife means and for releasing the cut sheet as said knife is moved up away from said web.

12. Apparatus according to claim 10 wherein said web holding means comprises at least one part of said web feeding means.

13. Apparatus according to claim 8 wherein said web feeding means comprises first and second roller means for tightly engaging opposite sides of said web, and drive means for rotating said first roller means in a direction to advance said web toward said sheet supporting means.

14. Apparatus according to claim 13 further including means for actuating said drive means and means for terminating operation of said drive means after said first roller means has turned through substantially a single revolution.

15. Apparatus according to claim 13 wherein said first roller means comprises a plurality of drive rollers mounted side by side on a common shaft, and further including finger members interposed between said drive rollers and between said web and said second roller means for gathering and corrugating said web.

16. Apparatus according to claim 1 wherein said two members are portions of a single belt.

17. Apparatus according to claim 1 wherein said two members constitute two discrete belts.

18. Apparatus for heat shrinking a sheet of heat shrinkable plastic film onto a container so as to form a closure for said container comprising:

first and second flexible heatable members;

first means for gripping said first and second members together at one end thereof;

second means for gripping said first and second members together at the end opposite said one end thereof; and bidirectionally movable means coupled to said first and second means for moving said first and second means so as to selectively cause said members to (a) flex in a first direction and move away from one another intermediate their opposite ends so as to provide a space therebetween for insertion of a sheet of heat shrinkable film and a container to be capped with said film or (b) flex in a second opposite direction and move closer to one another intermediate said opposite ends so as to press portions of said sheet against said container.

19. Apparatus according to claim 18 wherein each of said heatable members comprises an electrical resistance heating element.

* * * * *